United States Patent [19]

Fujita

[11] 4,080,583

[45] Mar. 21, 1978

[54] ELECTRICAL MOTOR-DRIVEN TIMER

[75] Inventor: Teizo Fujita, Ibaraki, Japan

[73] Assignee: Izumi Denki Corporation, Osaka, Japan

[21] Appl. No.: 730,099

[22] Filed: Oct. 6, 1976

[51] Int. Cl.[2] ..... H01H 43/02

[52] U.S. Cl. ..... 335/74; 335/75; 200/38 R

[58] Field of Search ..... 335/68, 69, 71, 72, 335/73, 74, 75, 76; 200/38, 39

[56] References Cited

U.S. PATENT DOCUMENTS

| | | | |
|---|---|---|---|
| 3,947,789 | 3/1976 | Fujita et al. | 335/75 X |
| 3,973,443 | 8/1976 | Muhling et al. | 335/75 X |

*Primary Examiner*—George Harris

*Attorney, Agent, or Firm*—Pollock, Vande Sande & Priddy

[57] ABSTRACT

An electrical motor-driven timer has a frame, which has a substantially rectangular section and which is comprised of a main plate, a substantially L-shaped frame member and a switch mechanism support member. A switch mechanism is mounted on one side of the support member. An electromagnetic device is received in the substantially lower half part of the frame for operating the switch mechanism. A timing mechanism is received in the substantially upper half part of the frame for actuation and timing operation of the switch mechanism.

15 Claims, 13 Drawing Figures

ELECTRICAL MOTOR-DRIVEN TIMER

BACKGROUND OF THE INVENTION

This invention relates to an electrical motor-driven timer.

This invention is an improvement on the electrical motor-driven timer disclosed in the U.S. patent application Ser. No. 522,833 entitled "MOTOR TIMER" filed Nov. 11, 1974 by T. Fujita, T. Ohashi and T. Chiba, granted Mar. 20, 1976 to the same applicants as U.S. Pat. No. 3,947,789, and assigned to the assignee of the present application.

SUMMARY OF THE INVENTION

An object of the present invention is to provide a compact and easy-to-assemble motor timer in which component parts are divided into a plurality of independent blocks arranged in most effective relative positions.

Another object of the present invention is to provide a motor timer with a construction suitable for mass production, including a specially rugged frame with a high dimensional accuracy for a high assembly efficiency.

A further object of the invention is to provide a motor timer including a frame containing a gear train, in which a gear group common to various timings setable in individual timers are adapted to be arranged in a space separate from the space for the other gear group which varies in arrangement as the setable timings in individual timers differ for one another.

A still further object of the invention is to provide a motor timer in which a reduction gear group for determining the setable range of timing is contained separately from a main gear and a clutch mechanism which may be commonly utilized to all the timers having different ranges of setable timing, so that the reduction gear block for determining the setable range of timing may be preassembled.

Still another object of the invention is to provide a motor timer in which the operating system of the clutch mechanism has a simple construction to facilitate assembly work.

An even further object of the invention is to provide a motor timer including an operating indicator capable of instantaneous and timed indication with a very simple construction without increasing the number of component parts.

An even further object is to provide a compact and easy-to-assemble motor timer in which an operating member for opening or closing an instantaneous contact section and another operating member for opening or closing a timing contact section are rotatably arranged in juxtaposition on a lateral pin disposed at the top of a leaf-spring contact block, thus simplifying the relative construction of the leaf-spring contact block and the operating members therefor.

In order to achieve the above objects, there is provided according to one aspect of the present invention an electrical motor-driven timer comprising: a frame including a main plate, a substantially L-shaped frame member, and a switch mechanism support member, said frame having a substantially rectangular section; a switch mechanism mounted and supported on one side of said support member; an electromagnetic device received in the substantially lower half part of said frame for operating said switch mechanism; and a timing mechanism received in the substantially upper half part of said frame for providing a timed operation in addition to the operation of said switch mechanism by said electromagnetic device.

In order to achieve the above objects, there is provided according to another aspect of the invention an electrical motor-driven timer comprising: a frame having a substantially rectangular section and including a main plate with a scale plate attached on the upper surface thereof, a yoke, and a switch mechanism support member made of an insulating material; a timing mechanism contained in the substantially upper half part of said frame and including a motor, a reduction gear train coupled with said motor for transmitting the rotation of said motor, a main gear for instructing a predetermined time delay, and a clutch gear for coupling said reduction gears with said main gear, said main gear having a pointer mounted on the shaft thereof and positioned over said scale plate; an electromagnetic device disposed in the substantially lower half part of said frame, said electromagnetic device including an armature, a solenoid, and an iron core magnetically coupled to said yoke, said solenoid being adapted to be energized simultaneously with the energization of said timer thereby to operate said armature; and a switch mechanism supported on said support member, said switch mechanism including a contact block, said contact block including an instantaneous contact group operated simultaneously with the energization of said timer, a timing contact group operated with said predetermined time delay and normally-closed motor input contacts adapted to be open with said time delay, said switch mechanism further including instantaneous operation cam member, a timing operation cam member, and a trip lever, said instantaneous-operation cam member and said timing-operation cam member being mounted above said contact block, said instantaneous-operation cam member being adapted to rotate to operate said instantaneous contact group, said timing-operation cam member being adapted to rotate to operate said timing contact group and said normally-closed motor-input contacts, said trip lever being disposed above said cam members rotatably a plane perpendicular to the plane of rotation of said cam members and having its lower end removably engaging said timing-operation cam member and its upper end including a part projected to the upper surface of said main gear, said projected part being pressed into rotation by a protrusion provided on the upper surface of said main gear when said main gear rotates by a predetermined angle corresponding to said predetermined time delay.

In order to achieve the above objects of the invention, there is provided according to still another aspect of the invention an electrical motor-driven timer comprising a switch mechanism section, an electro-magnetic device section and a timing mechanism section including a plurality of contacts, a part of said contacts being operated immediately after the energization of said timer, the other part of said contacts being operated with a predetermined time delay after the energization of said timer; wherein said timing mechanism includes a first section containing a motor, a second section containing a reduction gear train coupled to said motor, and a third section having a main gear for setting said predetermined time delay and ordering the timing operation and a clutch gear removably engaging said reduction gear train, said motor being started immediately upon the energization of said timer, said electromagnetic device being also energized immediately upon the energization of said timer, said switch mechanism including first operating cam means for operating said part of said contacts immediately in response to the energization of said electromagnetic device, said timer further including clutch-operating means for operating said clutch gear in response to the operation of said first operating cam means thereby to rotate said main gear, said switch mechanism further including second operating cam means for operating said other part of said contacts in response to a timed operation command produced by said main gear when said main gear rotates by a predetermined angle corresponding to said predetermined time delay.

DESCRIPTION OF THE PREFERRED EMBODIMENTS

Figure 1:
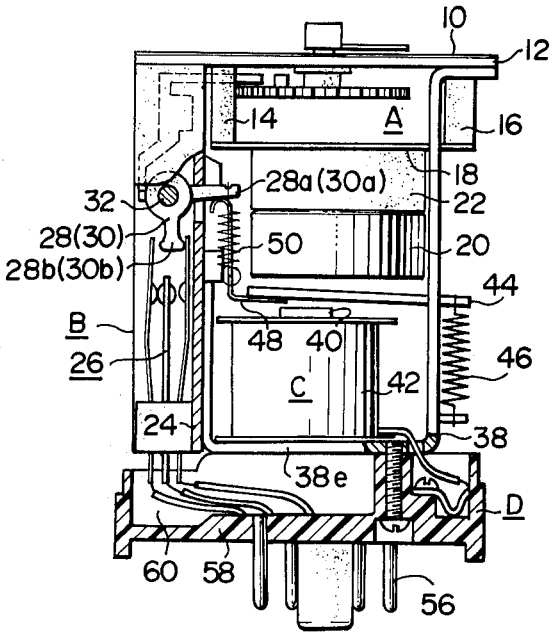
FIG. 1 is a partially-cutaway front view of an embodiment of the present invention.
Figure 2:
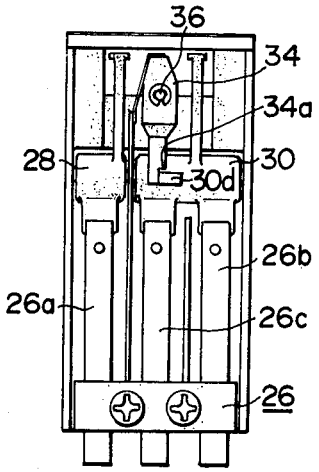
FIG. 2 is a side view of the timer show in FIG. 1.
Figure 3:
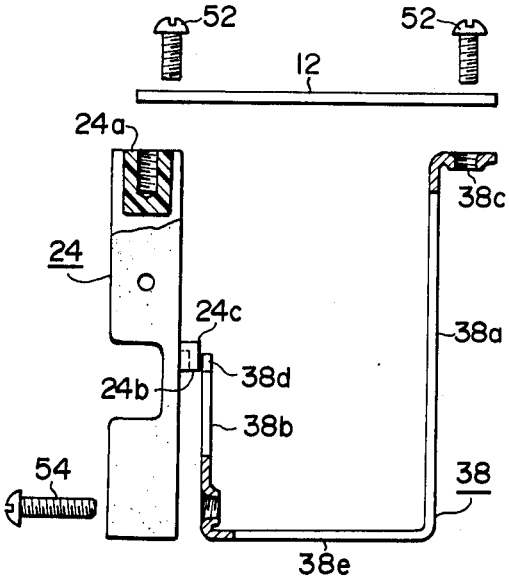
FIG. 3 is an exploded view of the frame of the motor timer according to the embodiment of FIG. 1.
Figure 4:
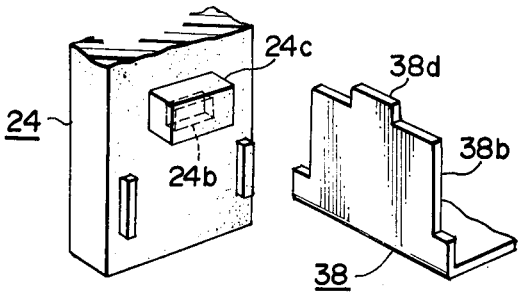
FIG. 4 is a perspective view showing a part of the frame of FIG. 3.
Figure 6:
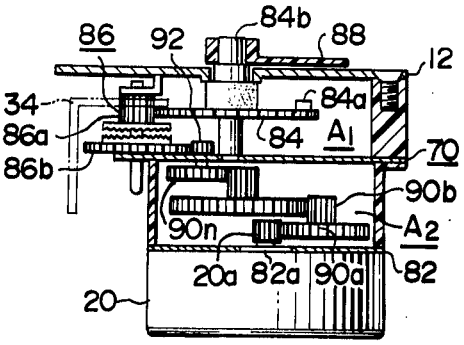
FIG. 6 is a longitudinal sectional view of the frame of FIG. 5 with the gear train of the timing mechanism contained therein.
Figure 5:
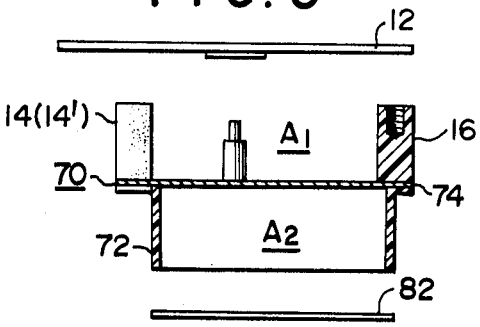
FIG. 5 is a longitudinal sectional view of the frame section for containing the timing mechanism.
Figure 7:
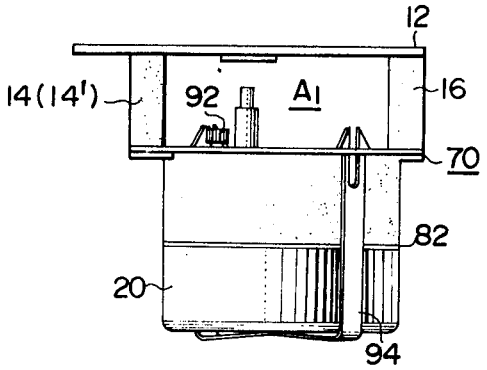
FIG. 7 is a front view of the embodiment of FIG. 6 with a motor mounted thereon.
Figure 8:
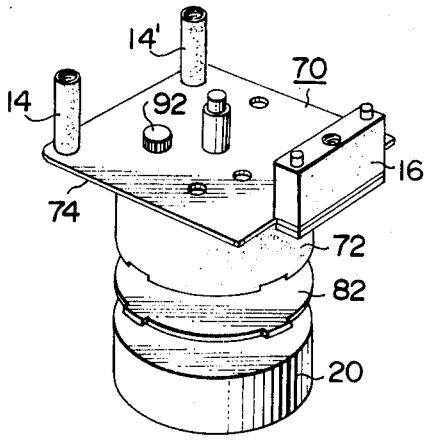
FIG. 8 is a perspective view of the embodiment of FIG. 7.
Figure 9:
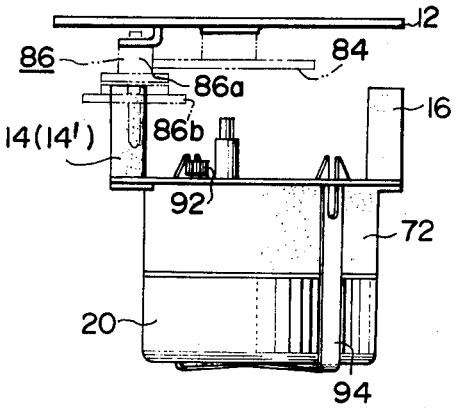
FIG. 9 is a front view of the embodiment of FIG. 6 from which some of the component parts are removed.
Figure 10:
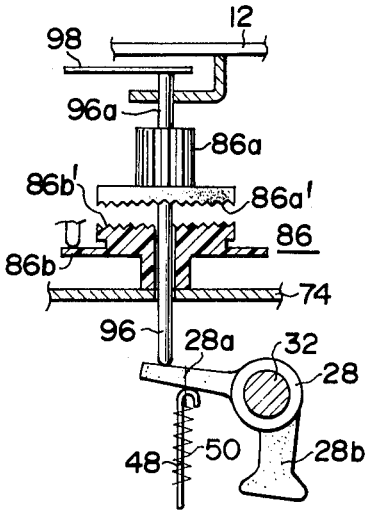
FIG. 10 is a fragmentary sectional view showing the clutch mechanism.
Figure 11:
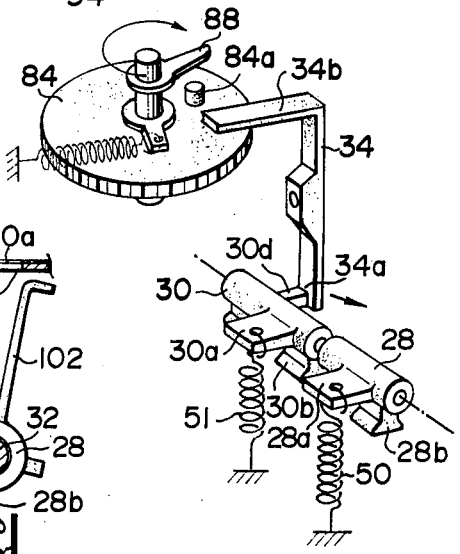
FIG. 11 is a fragmentary perspective view showing the relation between cam operating members and the timing mechanism.

The present invention will be described in detail below with reference to embodiments thereof. In FIGS. 1 to 4, reference character A shows a timing mechanism. Numeral 10 shows a scale plate attached to the upper surface of a main plate 12. The lower surface of the main plate 12 is coupled with a support plate 18 through connecting members 14 and 16. Timing elements such as a clutch mechanism, etc. as shown in FIG. 6 are interposed between the support plate 18 and the main plate 12. A drive motor 20 and a reduction gear block 22 are mounted on the lower side of the support plate 18. Character B shows a switch mechanism. A contact block 26 including instantaneous contacts **26*a*, timing contacts 26*b* and motor contacts 26*c* are secured to the lower end of a switch mechanism support member 24 of a resin material. At the upper end of the contact block 26 is positioned an instantaneous-operation cam member 28 for operating the instantaneous contacts 26*a*. This cam member 28 and a timing-operation cam member 30 for operating the timing contacts 26*b* and the motor contacts 26*c* are rotatably supported on a lateral shaft 32 of the support member 24. A trip lever 34 with the bottom engaging section 34*a* thereof engageable with the engaging protrusion 30*a* of the timing-operation cam member 30 is supported rotatably on a pin 36 erected on the support member 24. The trip lever 34 has the upper end thereof substantially in the shape of inverted L, the foremost end of which is associated with the timing mechanism A. By the rotation of the timing mechanism A the timed operation of which is associated with the foremost end of the trip lever 34, the bottom engaging section 34*a* of the trip lever 34 is disengaged from the engaging protrusion 30*d* of the timing-operation cam member 30, thus permitting free motion of the timing-operation cam member 30. Character C shows an electromagnetic device having a yoke 38, a fixed iron core 40, a coil 42, an armature 44 and a restitution spring 46. The electromagnetic device C and the switch mechanism B are so arranged that an operating piece 48 mounted on a free end of the armature 44 is located opposedly to the lower side of a horizontal piece 28*a* of the instantaneous-operation cam member 28, while at the same time a spring 50 is held between the horizontal piece 28*a* and the operating piece 48 in association therewith, so that the instantaneous-operation cam member 28 is operated in immediate response to the attraction and repulsion of the armature 44. The timing-operation cam member 30 is also associated with the armature 44 by a spring 51 (FIG. 11). Even if the armature 44 is cause to be in the attracted position, the timing-operation cam member 30 can not immediately rotate and therefore energy is stored in the spring 51 (FIG. 11) as long as the trip lever 34 is engaged with the cam member 30, until the cam member 30 is disengaged from the trip lever 34** and is rotated by the stored energy of the spring.

It will be easily understood from the drawings that in response to the operation of the cam members 28 and 30, the normally-open contacts and the normally-closed contacts of the switch mechanism B are closed and opened respectively. This operation will be described in further detail below.

In the embodiment under consideration, the yoke 38 is substantially L-shaped and preferably has a couple of vertical pieces including a long leg **38*a* and a short leg 38*b*. The support member 24 is secured to the short leg 38*b*. The support member 24 and the yoke 38 makes up a substantially channel-shaped frame member. The uppermost mounting part 38*c* of the long leg 38*a* and the uppermost mounting part 24*a* of the support member 24 are fixedly secured with screws 52 to the lower surface of the main plate 12** of the timing mechanism A, thus constituting a substantially rectangular frame.

Preferably, to form the frame, the upper end of the short leg **38*b* of the yoke 38 is formed with a protrusion 38*d*. An expanded portion 24*c* with a recess 24*b* underside thereof is formed on that part of the wall of the support member 24 which corresponds to the protrusion 38*d* of the yoke, so that the protruded portion 38*d* of the yoke 38 is inserted into the recess 24*b* from underside thereby to secure the support member 24 to the yoke 38 with a screw 54** at the lower end thereof.

The frame of the timer is thus constructed substantially in the rectangular shape by the main plate 12, the support member 24 and the yoke 38, so that the component parts are mounted on this frame. In this way, a rugged frame is obtained, with the result that stress imposed on such a component part as the timing mechanism as mounted on the panel is reduced, thereby providing a motor timer with superior shock resistance characteristics.

Character D shows a base disposed under the switch mechanism B and the electromagnetic device C to enable the operation of the timer removably plugged in the socket on a panel or like. The base D includes an insulating base 58 with a lead terminal 56 projected from the lower side thereof for electrically connecting the timing mechanism A, the switch mechanism B and the electromagnetic device C to an external power supply and for leading out electrical output signals from the switch mechanism B. The insulating base 58 includes a space 60 for containing lead wires connected to the lead terminal 56. The insulating base 58 is preferably coupled directly to the bottom portion 38*e* of the yoke 38 of the electromagnetic device C with the lead wires contained in the space 60.

By this construction, the timing mechanism A, the switch mechanism B, the electromagnetic device C and, if required, the base D making up component parts of the timer according to the present invention are respectively obtained in the form of preassembled blocks arranged in optimum relative positions, thus realizing a compact timer as a whole. Further, the assembly work is finalized by fastening the screws 52 from the upper side of the timer, thus providing means suitable for mass production much simpler than in the conventional methods.

The construction of the timing mechanism A will be described in detail with reference to FIGS. 5 to 9. Reference numeral 70 shows a frame having cylindrical member 72, an upper face plate 74 disposed on the top of the cylindrical member 72 and molded integrally therewith, and a plurality of coupling struts 14, 14' and 16 which are integrally molded with the cylindrical member 72 and erected from the upper surface of the upper face plate 74. The tops of the struts 14, 14' and 16 of the frame member 70 are coupled with the main plate 12, so that a first space $A_1$ is formed between the main plate 12 and the upper face plate 74. The lower end of the cylindrical member 72 is closed by the cover 82 thereby to form a second space $A_2$ within the cylindrical member 72. Numerals 84 and 86 show a main gear and a clutch gear respectively adapted to be contained in the first space $A_1$. The main gear 84 includes a projection 84*a* on a part of the upper surface thereof. In response to the rotation of the gear 84 by a predetermined angle, the projection 84*a* presses the end of the trip lever 34 associated with the switch mechanism B (FIGS. 1 and 2), with the result that the switch mechanism B is operated thereby to produce output signals. A pointer 88 mounted on the shaft 84*b* of the main gear 84 is adapted to indicate the time that has passed. The clutch gear 86 includes upper and lower gears 86*a* and 86*b* respectively having engaging sections opposed to each other. The upper gear 86*a* is connected with the main gear 84, while the lower gear 86*b* is operatively connected with the gear in the final stage of the reduction gear train described later. In response to the engagement and disengagement of the engaging sections of the upper and lower gears 86*a* and 86*b*, the reduction gear train is coupled and decoupled with the main gear 84 respectively. Numerals 90*a*, 90*b* . . . 90*n* show components constituting the reduction gear held within the second space $A_2$ between support members constituting the upper face plate 74 and the cover 82 respectively. The rotation of the drive gear 20*a* of the drive motor 20 is progressively reduced so that a predetermined rotational speed is obtained by the gear 90*n* in the last stage among the components of the reduction gear. The last-stage gear 90*n* is for transmitting rotation to the lower gear 86*b* of the clutch gear 86 through the transmission gear 92 projected from the upper face plate 74 into the first space $A_1$ and secured to the same shaft as the last-stage gear 90*n*. The drive motor 20 is positioned under the frame 70. The drive gear 20*a* of the drive motor 20 is protruded into the second space $A_2$ through the hole 82*a* of the cover 82, so that the drive motor 20 is adapted to be integrated with the frame 79 by means of a substantially channel-shaped fitting 94.

According to the present invention, it will be seen that, among the gears making up the timing mechanism of the motor timer, the main gear 84 and the clutch gear 89 which may be utilized common to all the timers having different ranges of setable timing are contained in the first space $A_1$ while the reduction gear constituted by the components 90*a*, 90*b* . . . 90*n* which has to be varied as the setable range of timing differs is housed in the second space $A_2$. The fact that the reduction gear components 90*a*, 90*b* . . . 90*n* which has to be varied in accordance with the setable timing are preassembled in the frame 70 in preparation permits a very effective inventory control. Further, since the frame member 70 has the cylindrical member 72, the upper face plate 74 and the coupling struts 14, 14' and 16 molded integrally with each other, the number of the required component parts is reduced while at the same time simplifying the assembly work.

The upper face plate 74 is preferably made of a metal material or, if desired, may be molded integrally with the cylindrical member 72 by the same plastics material as that of the cylindrical member 72.

The clutch mechanism according to the present invention will be described in detail below with reference to FIGS. 1, 2, 6, 10, 11, 12 and 13.

One of the features of the present invention resides in that in the above-described construction, the coupling and decoupling operation of the clutch mechanism 86 is interlocked with the instantaneous-operation cam member 28. The clutch gear 86 has a couple of upper and lower gears 86*a* and 86*b* with engaging sections 86*a'* and 86*b'* respectively opposed to each other, and an operating shaft 96 secured to the upper gear 86*a* and loosely passing through the central portion of the lower gear 86*b*. A spring plate 98 in contact with the top 96*a* of the support shaft 96 of the upper gear 86*a* gives to the upper gear 86*a* and the operating shaft 96 a constant tendency of downward motion, while at the same time causing the operating shaft 96 to be projected downward from the upper support plate 74. The instantaneous-operation cam member 28 is rotatably mounted on the lateral shaft 32 at the top of the support member 24 carrying the contact block 26, and tends to be rotated counterclockwise (as viewed in FIG. 10) by the spring 50. The cam member 28, which is substantially angle shaped, has the vertical section 28*b* normally pressed against a movable piece for maintaining the normally-open and normally-closed ones of the instantaneous contacts among the contact block 26 in its open and closed state respectively. When the instantaneous-operation cam member 28 is permitted to rotate counterclockwise as viewed in FIG. 10, the vertical section 28*b* thereof is pressed against the movable piece for the normally-closed contacts thereby to open the normally-closed contacts while at the same time releasing the movable piece for the normally-open contacts thereby to permit the normally-open contact to be closed. The horizontal piece 28*a* of the instantaneous-operation cam member 28 faces the inside of the electromagnetic device B and has the underside thereof opposed to the operating piece 48 mounted on the free end of the arature 44 while the upper side thereof is disposed opposedly to the lower end of the operating shaft 96 of the clutch gear 86. Upon the excitation of the electromagnetic device B, therefore, the armature 44 is attracted toward the fixed iron core 40. The instantaneous-operation cam member 28 which has thus far been prevented from the counterclockwise rotation (as viewed in FIG. 10) by the operating piece 48 of the armature 44 is released and begins to rotate counterclockwise (as viewed in FIG. 10) by the action of the spring 50. This rotation causes the vertical piece 28*a* to actuate the instantaneous-contacts thereby to produce instantaneous signals. At the same time, the lower end of the operating shaft 96 of the upper gear 86*a* is set free, so that the upper gear 86*a* is moved downward by the spring plate 98 opposed to the upper end 96*a* of the support shaft 96 of the upper gear 86*a*. The engaging section 86*a'* of the upper gear 86*a* engages the engaging section 86*b'* of the lower gear 86*b* thereby to actuate the clutch gear 86. The engagement of the clutch gear 86 causes the timing mechanism A to begin the timing operation. Upon the de-energization of the electromagnetic device B, the armature 44 is of course rotated counterclockwise (as viewed in FIG. 12) by the restitution spring 49 (FIG. 1), with the result that the instantaneous-operation cam member 28 and the clutch gear 86 are restored to the original states thereof. In other words, the clutch gear 86 is disengaged.

The timing-operation cam member 30 making up the switch mechanism B, together with the instantaneous-operation cam member 28, are supported rotatably on the lateral pin 32 mounted on the support frame 24, and is supplied with the rotational force in the counterclockwise direction (as viewed in FIG. 11) by the spring 51. The horizontal piece 30*a* is opposed to the operating piece 48 of the free end of the armature 44 of the electromagnetic device B, while the vertical piece 30*b* is so positioned as to operate the timing contacts 26*b* and 26*c* of the contact block 26. Further, the timing-operation cam member 30 has an engaging section 30*d* engaged with the engaging section 34*a* at the lower end of the trip lever 34 operatively connected with the timing mechanism A. Normally, even if the armature 44 is actuated, this engagement prevents the counterclockwise rotation (as viewed in FIG. 11) of the timing-operation cam member 30 which otherwise might be caused by the spring 51. The disengagement of the engaging section 30*d* from the engaging section 34*a* at the lower end of the trip lever 34 causes the timing-operation cam member 30 to rotate counterclockwise rotation (as viewed in FIG. 11), whereupon the timing contacts 26*b* and 26*c* are operated by the vertical piece 30*b*.

This construction permits the instantaneous-operation cam member 28 and the timing-operation cam member 30, together with the contact block 26, to be mounted on the support frame to provide a preassembled unit. This preassembled unit is conveniently mounted on the side of the electromagnetic device B in such a manner that the lower end of the operating shaft 96 of the clutch gear 86 is opposed to the upper surface of the horizontal piece 28*a* of the instantaneous-operation cam member 28, while the operating member 48 of the armature 44 is opposed to the lower side of the horizontal piece 28*a*. In this way, the overall configuration of the timer is simplified, and offers the advantages that assembly work is facilitated on the one hand and the component parts are conveniently prepared in preassembled blocks on the other. Furthermore, in operation, the clutch gear is set in engagement without fail upon generation of an instantaneous signal.

Figure 12:
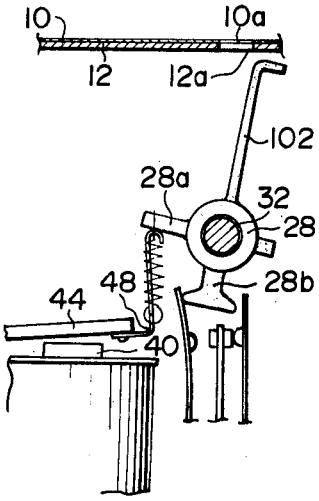
FIG. 12 is a front view showing a mechanism for indicating the operating conditions of the instantaneous-operation cam member.
Figure 13:
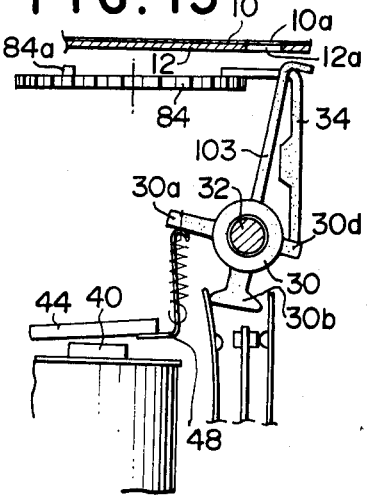
FIG. 13 is a front view showing a mechanism for indicating the operating conditions of the timing-operation cam member.

A mechanism for indicating the operating conditions of the cam members will be described below with reference to FIGS. 12 and 13.

The motor timer according to the embodiment under consideration has an operation indicator as a feature thereof without affecting the simple construction thereof. Indication members 102 and 103 extending upward are integrated with or attached to the instantaneous-operation cam member 28 and the timing-operation cam member 30 respectively. The upper ends of the indication members 102 and 103 are positioned in proximity to the lower side of the main plate 12. Windows 12*a* and 10*a* are formed in the main plate 12 and the dial 10 attached to the upper surface of the main plate 12 at such positions as they are opposed to the upper ends of the indication members 102 and 103 when the instantaneous-operation cam member 28 and the timing-operation cam member 30 are in operation respectively. In this construction, the upper ends of the indication members 102 and 103 are not exposed to the windows 12*a* and 10*a* of the main plate 12 and the dial 10 until the actuation of the instantaneous-operation cam member 28 and the timing-operation cam member 30 respectively. By watching the upper ends of the indication members 102 and 103 through the windows 12*a* and 10*a*, therefore, the operating conditions of the instantaneous-operation cam member 28 and the timing-operation cam member 30 may be recognized. This watching process is facilitated by coloring the upper ends of the indication members 102 and 103 respectively in red or other.

The operation of the motor timer according to the present invention will be generally explained below. Upon receipt of an exciting signal from the pin 56, the electromagnetic device C is excited and the armature 44 is attracted toward the fixed iron core 40. The instantaneous-operation cam member 28 that has thus far been prevented from rotating clockwise (as viewed in FIG. 1) by the operating piece 48 at the free end of the armature 44 is set free and rotated clockwise (as viewed in FIG. 1) by the spring 50, so that the instantaneous contacts 26*a* of the contact block 26 is actuated by the vertical piece 28*b*, thereby producing an instantaneous signal. At the same time, the operating shaft 96 of the clutch gear 86 that has so far been pushed up by the horizontal piece 28*a* of the cam member 28 is pushed downward by the action of the spring plate 98. The engaging section 86*a'* of the upper gear 86*a* engages the engaging section 86*b'* of the lower gear 86*b*, thereby actuating the clutch gear 86. In the meanwhile, the horizontal piece 30*a* of the instantaneous-operation cam member 28, which has thus far been pushed up by the operating piece 48 of the armature 44 like the horizontal piece 38*a* of the instantaneous-operation cam member 28, is set free by the attracting operation of the armature 44. Under this condition, the engaging section 30*d* of the timing-operation cam member 30 remains engaged with the lower end 34*a* of the trip lever 34, and therefore the cam member 30 continues to be prevented from rotating clockwise (as viewed in FIG. 1). Also, the normally-closed contacts 26c for motor input in the contact block 26 is kept closed, so that upon the application of an exciting signal to the electromagnetic device C, the drive motor 20 begins to be driven. The rotation of the drive motor 20 is transmitted through the drive gear 20a, the reduction gear components 90a, 90b, . . . 90n and the clutch gear 86, to the main gear 84 for timing operation. When the main gear 84 for timing operation rotates a predetermined angle, namely when a predetermined time has passed, the projection 84a on the upper surface of the timing main gear 84 presses the upper end 34b of the trip lever 34 thereby to swing the trip lever 34 axially of the cam members 28 and 30. This swinging releases the engagement of the timing-operation cam member 30 with the engaging section 30d, thus allowing free clockwise (as viewed in FIG. 1) rotation of the timing-operation cam member 30. The vertical piece 30b of the timing-operation cam member 30 actuates the timing contacts 26b of the contact block 26, thereby producing timing signals. At the same time, the motor input contacts 26c are opened thereby to stop the rotation of the drive motor 20. By the de-energization of the electromagnetic device C, the restituting operation of the armature 44 of course restores the instantaneous-operation cam member 28, the timing-operation cam member 30 and the operating shaft 96 of the clutch gear 86 are to the original conditions thereof.

It will be thus understood that according to the aforementioned embodiments of the invention, the instantaneous-operation cam member 28 and the timing-operation cam member 30, together with the contact block 26, are preassembled on the support frame 24, thus forming a preassembled unit in the form of a contact block for easy assembly work of the timer. Further, the instantaneous contacts 26a, the timing contacts 26b and the motor input contacts 26c may be combined into a block as a contact block 26. The entire configuration is thus simplified while at the same time reducing the size of the timer.

The advantages of the motor timer with this construction over the conventional apparatuses, especially, over the U.S. Pat. No. 3,947,789, are that (1) The dimensional accuracy of each component part is easily obtained, thus contributing to an improved accuracy of the timer as a whole, because of a lesser number of coupling sections involved;

(2) in the case where the main plate of the timer is mounted as a support member on a panel or like, less stress is imposed on gears, resulting in a very small deformation;

(3) the fact that the space for receiving the leaf-spring contacts are extended longitudinally, thus improving the contact performance;

(4) the yoke is L-shaped and therefore costs lower; and (5) the fact that the component parts are contained in a frame including a yoke and like and assembled as a block, especially, the fact that the assembly is fastened with screws from the upper side of the main plate simplifies the field work, thus facilitating mass production.

I claim:

1. An electrical motor-driven timer comprising:

a frame including a main plate, a substantially L-shaped frame member, and a switch mechanism support member, said frame having a substantially rectangular section;

a switch mechanism mounted and supported on one side of said support member;

an electromagnetic device received in the substantially lower half part of said frame for operating said switch mechanism; and a timing mechanism received in the substantially upper half part of said frame for providing a timed operation in addition to the operation of said switch mechanism by said electromagnetic device.

2. An electrical motor-driven timer according to claim 1, in which said frame member is constituted by the yoke of said electromagnetic device.

3. An electrical motor-driven timer according to claim 1, in which said timing mechanism is mounted under said main plate.

4. An electrical motor-driven timer according to claim 1, in which said frame further includes first and second plate members parallel to said main plate; and in which said timing mechanism includes a main gear interposed in a first space between said main plate and said first plate member for producing a predetermined timing signal, a clutch gear, a train of reduction gear components contained in a second space between said first plate member and said second plate member, and a motor positioned on the lower side of said second plate member; said motor and said electromagnetic device being actuated upon the energization of said timer, said clutch gear being actuated upon the energization of said electromagnetic device, so that the rotation of said motor is transmitted through said clutch gear to said main gear thereby to perform a predetermined timing operation.

5. An electrical motor-driven timer according to claim 4, in which said train of reduction gear components is surrounded by said first and second plate members and a cylindrical member.

6. An electrical motor-driven timer according to claim 4, in which said first plate member is disposed on the top of a cylindrical member and molded integrally with said cylindrical member, said timer further comprising a plurality of struts molded integrally with said cylindrical member and projected to the upper side of said first plate member, said struts being coupled to said main plate thereby to form said first space, said second plate member closing the lower end of said cylindrical member thereby to form said second space.

7. An electrical motor-driven timer according to claim 6, in which said cylindrical member is made of plastics, and said first plate member is made of a metal material.

8. An electrical motor-driven timer according to claim 6, in which both said cylindrical member and said first plate member are made of plastics.

9. An electrical motor-driven timer according to claim 1, in which said switch mechanism comprises a contact block including a plurality of instantaneous contacts mounted on said one side of said support member and instantaneously operated upon the energization of said timer, and a plurality of timing contacts operated with a predetermined time delay, means positioned above the upper side of said contact block for actuating said contact block, said means including an instantaneous-operation cam member and a timing-operation cam member, said instantaneous-operation cam member being adapted to actuate said instantaneous contacts instantaneously in response to the energization of said electromagnetic device caused by the actuation of said timer, said timing-operation cam member being adapted to actuate said timing contacts with said predetermined time delay, and a trip lever engaged removably with said timing-operation cam member, said trip lever being adapted to be actuated by the timed operation of said timing mechanism with said predetermined time delay following the energization of said electromagnetic device so as to be disengaged from said timing-operation cam member, thereby to permit the actuation of said timing-operation cam member.

10. An electrical motor-driven timer according to claim 9, further comprising first and second indicator means for indicating the operation of said instantaneous-operation cam member and said timing-operation cam member, each of said first and second indicator means being visible through a hole.

11. An electrical motor-driven timer according to claim 10, in which said first and second indicator means are formed integrally with said instantaneous-operation cam member and said timing-operation cam member respectively.

12. An electrical motor-driven timer according to claim 1, further comprising a base member with a plurality of lead terminals on the underside of said frame having a substantially rectangular section, said lead terminals being for connecting an external electrical signal source with said timer and for leading-out output signals from said switch mechanism.

13. An electrical motor-driven timer comprising:

a frame having a substantially rectangular section and including a main plate with a scale plate attached on the upper surface thereof, a yoke, and a switch mechanism support member made of an insulating material;

a timing mechanism contained in the substantially upper half part of said frame and including a motor, a reduction gear train coupled with said motor for transmitting the rotation of said motor, a main gear for instructing a predetermined time delay, and a clutch gear for coupling said reduction gear train with said main gear, said main gear having a pointer mounted on the shaft thereof and positioned over said scale plate;

an electromagnetic device disposed in the substantially lower half part of said frame, said electromagnetic device including an armature, a solenoid, and an iron core magnetically coupled to said yoke, said solenoid being adapted to be energized simultaneously with the energization of said timer thereby to operate said armature; and a switch mechanism supported on said support member, said switch mechanism including a contact block, said contact block including an instantaneous contact group operated simultaneously with the energization of said timer, a timing contact group operated with said predetermined time delay and normally-closed motor input contacts adapted to be open with said time delay, said switch mechanism further including instantaneous-operation cam member, a timing operation cam member, and a trip lever, said instantaneous-operation cam member and said timing-operation cam member being mounted above said contact block, said instantaneous-operation cam member being adapted to rotate to operate said instantaneous contact group, said timing-operation cam member being adapted to rotate to operate said timing contact group and said normally-closed motor-input contacts, said trip lever being disposed above said cam members rotatably in a plane perpendicular to the plane of rotation of said cam members and having its lower end removably engaging said timing-operation cam member and its upper end including a part projected to the upper surface of said main gear, said projected part being pressed into rotation by a protrusion provided on the upper surface of said main gear when said main gear rotates by a predetermined angle corresponding to said predetermined time delay.

14. An electrical motor-driven timer according to claim 13, further comprising a base member with a plurality of lead terminals on the underside of said frame having a substantially rectangular section, said lead terminals being for connecting an external electrical signal source with said timer and for leading-out output signals from said switch mechanism.

15. An electrical motor-driven timer comprising a switch mechanism section, an electromagnetic device section and a timing mechanism section including a plurality of contacts, a part of said contacts being operated immediately after the energization of said timer, the other part of said contacts being operated with a predetermined time delay after the energization of said timer; wherein said timing mechanism includes a first section containing a motor, a second section containing a reduction gear train coupled to said motor, and a third section having a main gear for setting said predetermined time delay and ordering the timing operation and a clutch gear removably engaging said reduction gear train, said motor being started immediately upon the energization of said timer, said electromagnetic device being also energized immediately upon the energization of said timer, said switch mechanism including first operating cam means for operating said part of said contacts immediately in response to the energization of said electromagnetic device, said timer further including clutch-operating means for operating said clutch gear in response to the operation of said first operating cam means thereby to rotate said main gear, said switch mechanism further including second operating cam means for operating said other part of said contacts in response to a timed operation command produced by said main gear when said main gear rotates by a predetermined angle corresponding to said predetermined time delay.

* * * * *